US006899612B2

(12) United States Patent
Lawing

(10) Patent No.: US 6,899,612 B2
(45) Date of Patent: May 31, 2005

(54) POLISHING PAD APPARATUS AND METHODS

(75) Inventor: Andrew Scott Lawing, Phoenix, AZ (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 0 days.

(21) Appl. No.: 10/373,513

(22) Filed: Feb. 25, 2003

(65) Prior Publication Data

US 2004/0166780 A1 Aug. 26, 2004

(51) Int. Cl.[7] ..... B24D 11/00
(52) U.S. Cl. ..... 451/527; 451/539
(58) Field of Search ..... 451/527, 539, 451/285–289, 56, 443, 444; 51/298

(56) References Cited

U.S. PATENT DOCUMENTS

| | | | | |
|---|---|---|---|---|
| 5,569,062 | A | 10/1996 | Karlsrud | |
| 6,224,465 | B1 | 5/2001 | Meyer | |
| 6,245,679 | B1 | 6/2001 | Cook et al. | |
| 6,641,471 | B1 * | 11/2003 | Pinheiro et al. | 451/526 |
| 2001/0006875 | A1 * | 7/2001 | Moore | 451/41 |
| 2001/0053660 | A1 | 12/2001 | Burke et al. | |
| 2002/0058469 | A1 * | 5/2002 | Pinheiro et al. | 451/526 |
| 2002/0182401 | A1 | 12/2002 | Lawing | |
| 2003/0054735 | A1 * | 3/2003 | Misra et al. | 451/41 |

FOREIGN PATENT DOCUMENTS

| | | |
|---|---|---|
| EP | 0 769 350 A | 4/1997 |
| WO | WO 99/33615 A1 | 7/1999 |
| WO | WO 00/30159 A1 | 5/2000 |
| WO | WO 02/24415 A1 | 3/2002 |

OTHER PUBLICATIONS

Lawing, A. Scott, "Pad Conditioning and Pad Surface Characterization in Oxide Chemical Mechanical Polishing", The Materials Research Society, Spring Meeting Proceedings, Feb. 2002.

Lawing, A. Scott, "Pad Conditioning and Removal Rate in Oxide Chemical Mechanical Polishing", Proceedings of the Seventh International Chemical–Mechanical Planarization for ULSI Multilevel Interconnection Conference, Santa Clara, CA, Feb. 27–Mar. 1, 2002.

Lawing, A. Scott, "Polish Rate, Pad Surface Morphology and Pad Conditioning in Oxide Chemical Mechanical Polishing", Proceedings of the Fifth Internaional Symposium on Chemical Mechanical Polsihing, May 12–17, 2002.

* cited by examiner

*Primary Examiner*—M. Rachuba
(74) *Attorney, Agent, or Firm*—Blake T. Biederman

(57) ABSTRACT

Polishing pads having a surface morphology that results in a high degree of planarization efficiency when planarizing a wafer surface are disclosed. One conditioned polishing pad is non-porous and has a surface height distribution with a surface roughness Ra<3 microns. Another conditioned polishing pad is porous and has a surface height probability distribution with a pad surface height Ratio R≧60%, or alternatively has an asymmetric surface height probability distribution characterized by an asymmetry factor $A_{10} \leqq 0.50$. Methods of pad conditioning and planarizing a wafer using the polishing pads are also disclosed.

5 Claims, 13 Drawing Sheets

POLISHING PAD APPARATUS AND METHODS

BACKGROUND OF THE INVENTION

The present invention relates to chemical mechanical polishing (CMP), and in particular to optimized surface morphologies for polishing pads used in CMP apparatus.

In the fabrication of integrated circuits and other electronic devices, multiple layers of conducting, semiconducting, and dielectric materials are deposited on or removed from a surface of a semiconductor wafer. Thin layers of conducting, semiconducting, and dielectric materials may be deposited by a number of deposition techniques. Common deposition techniques in modem processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the substrate may become non-planar and require planarization. Planarizing a surface, or "polishing" a surface, is a process where material is removed from the surface of the wafer to form a generally even, planar surface. Planarization is useful in removing undesired surface topography and surface defects, such as rough surfaces, agglomerated materials, crystal lattice damage, scratches, and contaminated layers or materials. Planarization is also useful in forming features on a substrate by removing excess deposited material used to fill the features and to provide an even surface for subsequent processing.

Chemical mechanical planarization, or chemical mechanical polishing (CMP), is a common technique used to planarize substrates such as semiconductor wafers. In conventional CMP, a wafer carrier or polishing head is mounted on a carrier assembly and positioned in contact with a polishing pad in a CMP apparatus. The carrier assembly provides a controllable pressure that urges the substrate against the polishing pad. The pad is optionally moved (e.g., rotated) relative to the substrate by an external driving force. Simultaneously therewith, a chemical composition ("slurry") or other fluid medium is flowed onto the polishing pad and between the substrate and the polishing pad. The substrate surface is thus polished by the chemical and mechanical action of the pad surface and slurry in a manner that selectively removes material from the substrate surface.

During the polishing process, the polishing pad is "conditioned"—i.e., is treated by a pad conditioner—so that the pad surface characteristics are maintained. Without pad conditioning, the polishing pad surface characteristics change with time. As the polishing pad surface is initially conditioned for optimal polishing, alteration of the pad surface during polishing results in a loss of polishing efficiency and is generally considered undesirable.

The polishing efficiency in CMP is dictated by several polishing parameters, namely: pressure between the substrate and polishing pad, the nature of the slurry, the relative rotational speed of the substrate and polishing pad, the nature of the substrate surface, and the nature of the polishing pad surface.

Here, "efficiency" qualitatively refers to the ability to reduce the step height on a wafer surface with the least amount of material removed. Quantitatively, planarization efficiency PE is defined as:

$$PE \equiv \frac{RR_{High} - RR_{Low}}{RR_{High}} \quad \text{EQ. 1}$$

wherein $RR_{High}$ is the removal rate of material from relatively high elevation features, and $RR_{Low}$ is the removal rate of material from relatively low elevation features. According to Equation 1, $0 \leqq PE \leqq 1$.

FIG. 1 is a schematic close-up cross-sectional view of a polishing pad 10 having a surface 12 in contact with a substrate (hereinafter, "wafer") 20 having a surface 22. Pad surface 12 has a surface shape ("morphology") that is typically described as a "surface roughness." Wafer surface 22 has low areas 30 and high areas 32 that give the surface a topography. In an example embodiment, low areas 20 and high areas 32 arise due to device structures (e.g., vias, trenches, interconnects, etc.) formed in the wafer during the formation of integrated circuits (ICs).

FIG. 2A is a plot of the idealized planarization efficiency. At the initial stage I of planarizing, low areas 30 do not contact the pad so that the removal rate for these areas ($RR_{Low}$) is zero and PE=1. Further, during the intermediate stage II, both low and high areas 30 and 32 are contacted but the compression of the pad and the wafer step height dictate that $RR_{High} > RR_{Low}$, such that $0 < PE < 1$. In the final stage III when the high areas have been effectively removed, the high and low rates are equal so that PE=0. In ideal planarization, the process goes from stage I to stage II essentially instantaneously so that the ideal PE curve is a step function.

In practice, areas of different effective density on the wafer get planarized at different rates, so that stage II is not infinitely short. In this case, the planarization efficiency (PE) curve has a slope during stage II, as illustrated in FIG. 2B. The time it takes for PE to drop significantly below 1 (i.e., the time it takes the process from transitioning from stage I to stage II is called the "induction time," $T_I$. It is typically preferable to have a relatively long induction time so that only the high areas of the wafer are polished, followed by a steep slope in stage II so that the low-lying areas on the wafer are polished as little as possible. Processes that are characterized by a long induction time will typically result in lower dishing and erosion on surfaces consisting of multiple materials, such as are encountered in the final stages of polishing shallow trench isolation and copper dual damascene structures.

Techniques have been put forth to increase polishing efficiency. For example, U.S. Pat. No. 6,497,613 to Meyer, entitled "Methods and apparatus for chemical mechanical planarization using a microreplicated surface," describes polishing pad surface having a regular array of structures with sharp, distal apexes. The distal apexes contact the workpiece surface during polishing, whereby they ablate and become blunted. Thus, the planarization process starts out with aggressive polishing and a high removal rate, and finishes with a fine polishing and a low removal rate. This technique requires replacing the pad for each polishing operation, and is not amenable to a conditioning process that can maintain an optimized pad surface morphology.

Because of the large cost savings associated with planarizing surfaces as efficiently as possible, with as little loss of material as possible and with as little damage as possible, it is desirable to develop a polishing pad having a morphology that optimizes planarization performance, and methods for conditioning such pads to achieve and maintain the optimized morphology.

STATEMENT OF THE INVENTION

One aspect of the invention is a polishing pad for CMP that includes a non-porous conditioned pad surface characterized by a surface roughness distribution having a surface roughness Ra≦3 microns.

Another aspect of the invention is a polishing pad for CMP that includes a porous conditioned pad surface having a substantially flat surface characterized by a surface height probability distribution with a pad surface height ratio R≧60%, or alternatively R≧70%.

Another aspect of the invention is a polishing pad for CMP that includes a porous conditioned pad surface characterized by an asymmetric surface height probability distribution having an asymmetry factor $A_{10}$≦0.50

Another aspect of the invention is a method of conditioning a surface of a non-porous polishing pad. The method includes contacting a pad conditioner surface to the non-porous polishing pad surface, and moving the pad conditioner surface relative to the non-porous polishing pad surface while providing a force that presses the surfaces together, thereby forming a surface roughness in the non-porous polishing pad surface characterized by a surface roughness Ra≦3 microns.

Another aspect of the invention is a method of conditioning a surface of a porous polishing pad. The method includes contacting a pad conditioner surface to the porous polishing pad surface, and moving the pad conditioner surface relative to the non-porous polishing pad surface while providing a force that presses the surfaces together, thereby forming a surface roughness in the non-porous polishing pad surface characterized by an asymmetric surface height probability distribution having a pad surface height ratio R≧60%, or alternatively R≧70%.

Another aspect of the invention is a method of conditioning a surface of a porous polishing pad. The method includes contacting a pad conditioner surface to the non-porous polishing pad surface, and moving the pad conditioner surface relative to the non-porous polishing pad surface while providing a force that presses the surfaces together, thereby forming a surface roughness in the non-porous polishing pad characterized by an asymmetric surface height probability distribution having an asymmetry factor $A_{10}$≦0.50

DETAILED DESCRIPTION OF THE INVENTION

The present invention relates to chemical mechanical polishing (CMP) and in particular to optimized polishing pad morphology for CMP apparatus. The present invention relates to both solid (i.e., non-porous) polishing pads and porous polish pads. The present invention includes polishing pads having an optimized surface morphology i.e., a surface character that has a high planarization efficiency as compared to the prior art, as well as methods for conditioning the pads to achieve the optimized surface morphology. The invention is first described in connection with optimized solid (non-porous) polishing pads, followed by a description of the invention as it relates to optimized porous polishing pads.

Solid (i.e., Non-porous) Polishing Pads

Figure 1:
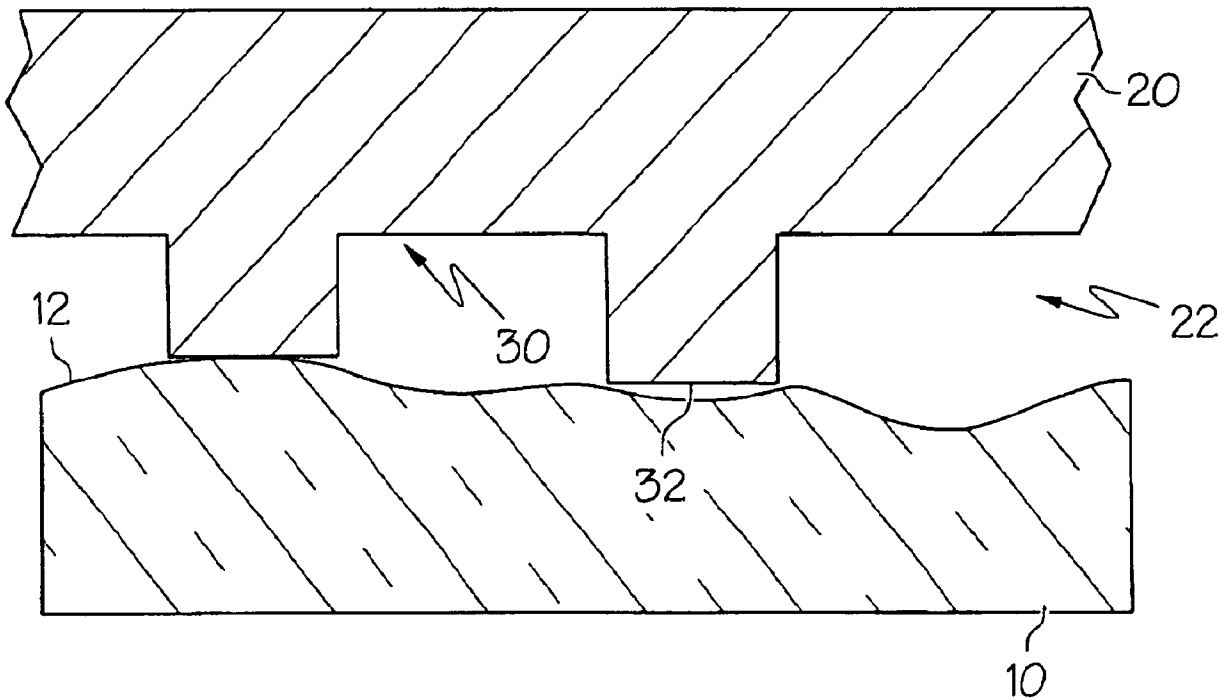
FIG. 1 (PRIOR ART)
FIG. 1 is a partial cross-sectional view of a polishing pad and a wafer illustrating the planarization of high and low wafer features on the wafer.
Figure 2B:
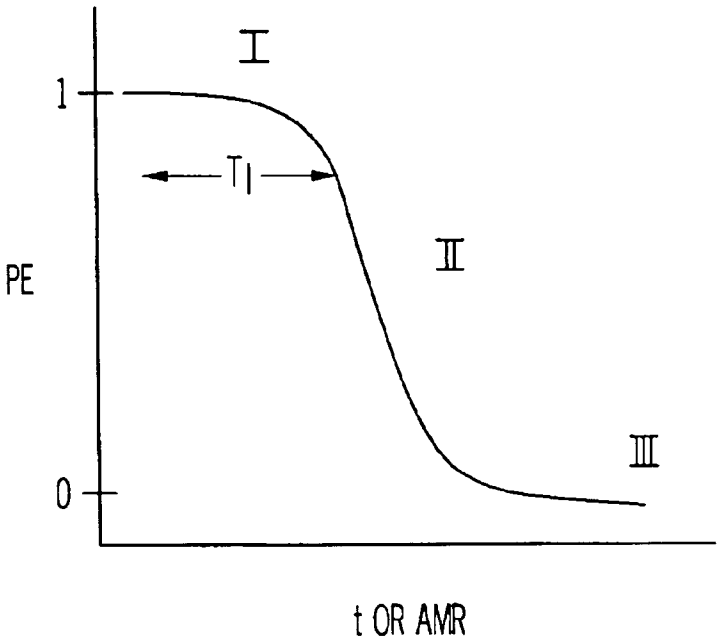
FIG. 2B (PRIOR ART)
FIG. 2B is a plot of the PE vs. t or AMR for a wafer with device topography illustrating a typical polishing efficiency.
Figure 2A:
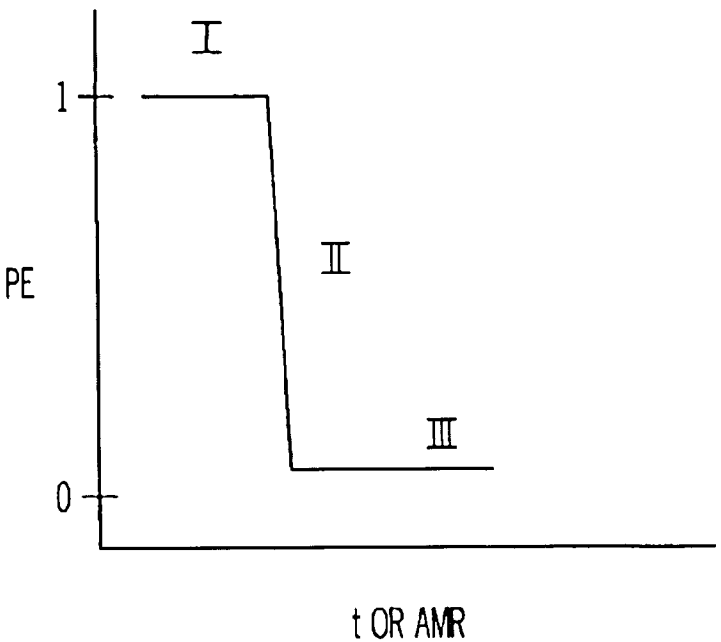
FIG. 2A (PRIOR ART)
FIG. 2A is a plot of polishing efficiency (PE) versus time (or alternatively, the amount of material removed "AMR") for a wafer with device topography illustrating an ideal polishing efficiency (PE)
Figure 3A:
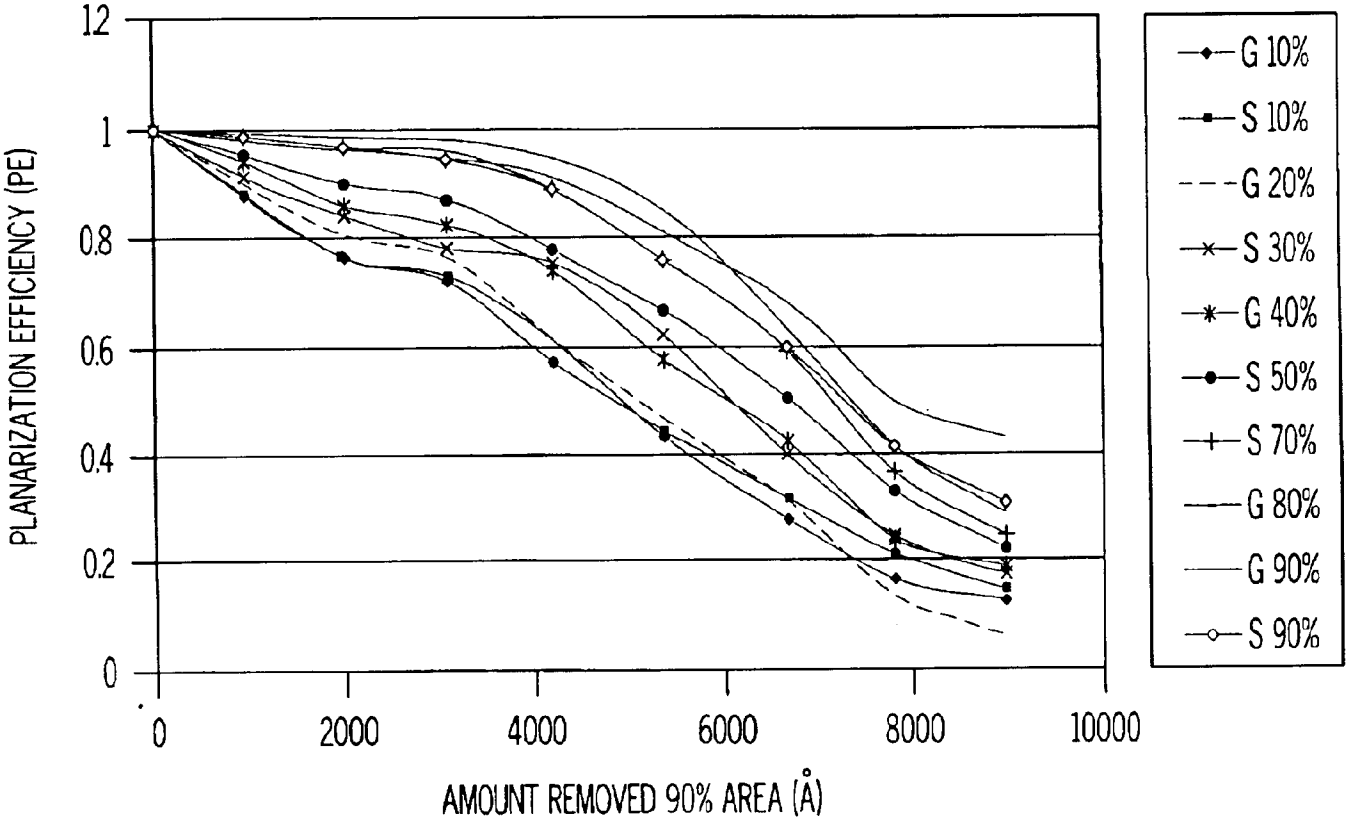
FIG. 3A (PRIOR ART)
FIG. 3A is a series of PE vs. AMR curves generated by planarizing wafers using a non-porous polishing pad with conventional surface morphology.

With reference to FIG. 3A, there is shown series of PE vs. Amount of Material Removed or "AMR" (Angstroms) curves generated by planarizing wafers using a conventional solid (i.e., non-porous) polishing pad having a conventional surface roughness. A conventional slurry (namely, Rodel ILD1300) was used in all cases. The wafers used were 200 mm TEOS (tetraethyl orthosilicate) wafers, obtainable as SKW 7-2 from SKW Associates, Santa Clara, Calif. The wafers included different wafer pattern densities. The legend in the plot in FIG. 3A indicates the feature-scale density as a percentage of the surface area formed in an oxide layer atop the silicon wafer. The letters "G" and "S" respectively refer to "gradual" and "step," referring to the nature of the density changes between adjacent regions on the wafer.

Figure 3B:
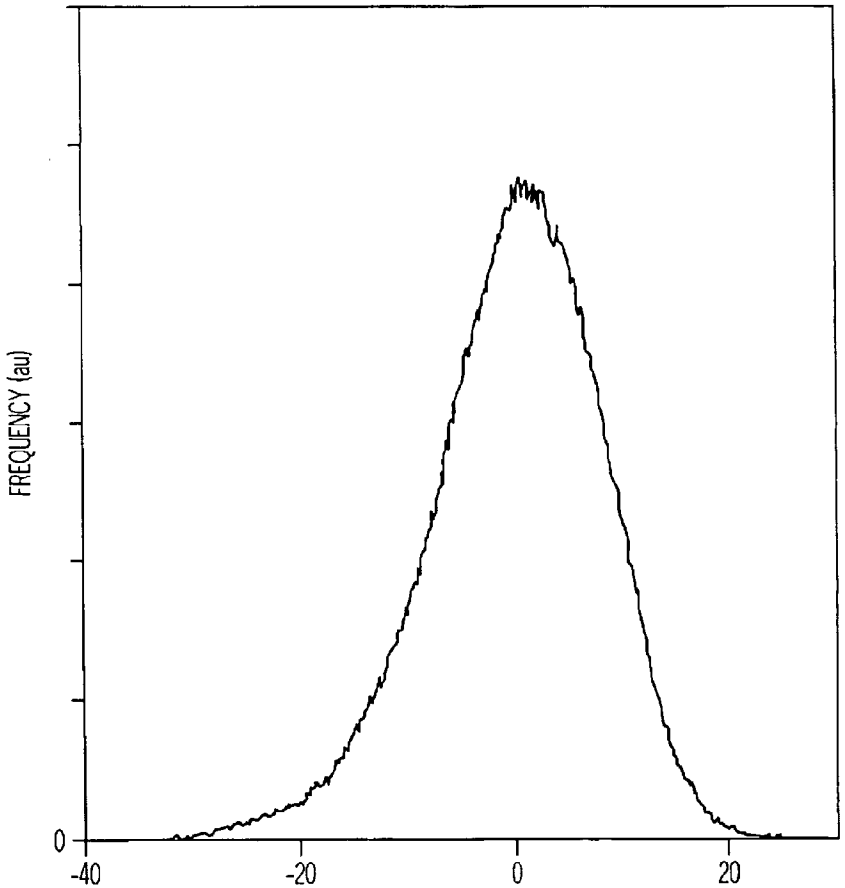
FIG. 3B (PRIOR ART)
FIG. 3B is a plot of height probability distribution (i.e., frequency versus height) for a conventional non-porous polishing pad such as that used to create the curves of FIG. 3A.

FIG. 3B is a plot of height probability distribution (i.e., frequency versus height) for a conventional non-porous polishing pad such as that used to create the curves of FIG. 3A In particular, the pad surface employed had a Gaussian surface roughness probability distribution with a surface roughness of Ra=5 microns. Conventional conditioned polishing pads have a surface roughness of Ra≧3.5 microns. Accordingly, FIG. 3A is representative of the planarization efficiency associated with the prior art polishing pad surfaces.

Figure 4A:
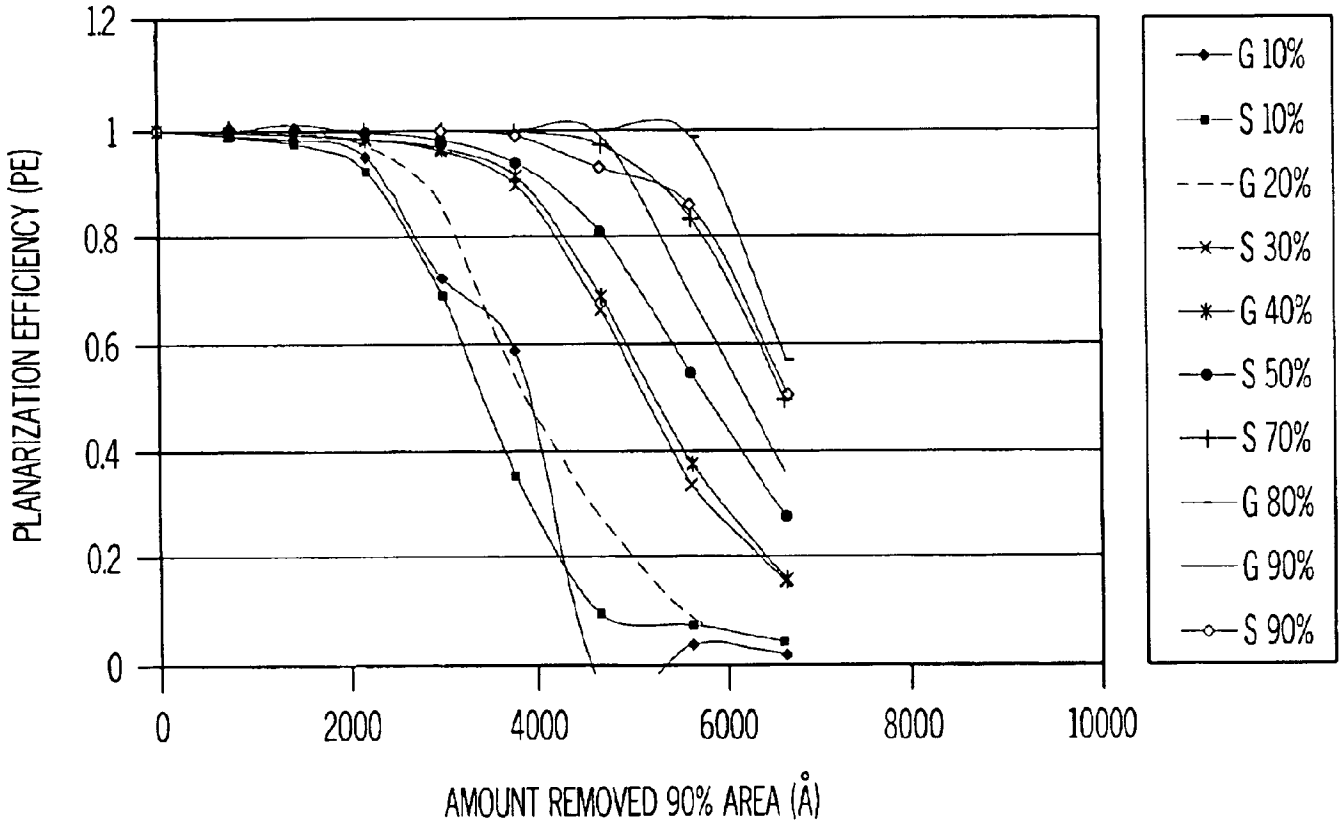
FIG. 4A is a series of PE vs. AMR curves generated by planarizing wafers using the non-porous polishing pad of the present invention.
Figure 4B:
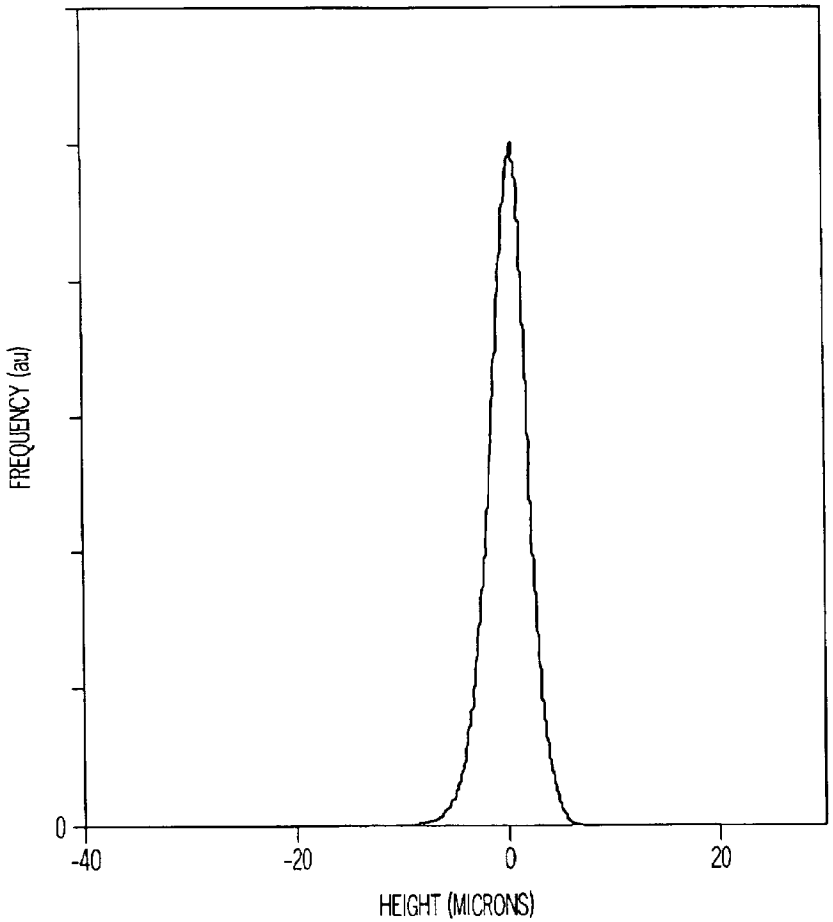
FIG. 4B is a plot of height probability distribution (i.e., frequency versus height) for the non-porous polishing pad of the present invention, such as used to create the curves of FIG. 4A.

With reference now to FIG. 4A, the same PE vs. AMR plot as in FIG. 3A is shown, except that the polishing surface employed had a Gaussian surface roughness probability distribution with a surface roughness Ra=2 microns as graphically illustrated in FIG. 4B. Such a low surface roughness is atypical of conventional polishing pad surfaces.

Generally, features of different densities polish at different rates, with low-density features polishing faster (i.e., have a higher removal rates) and planarize sooner than high-density features. However, from FIG. 4B it is clear that the polishing efficiency obtained is much higher than that of the prior art even though the surface roughness of the polishing pad is much less. For example, for the low-roughness pad of the present invention, planarization is achieved on the 10% and 20% features at about 6000 Angstroms removed. On the other hand, for the conventional roughness pad of the prior art, planarization is not completed until about 9000 Angstroms are removed.

This is a counterintuitive result. The inventors have discovered that conditioned polishing pad surface roughness values of Ra<3.5 microns result in a planarization efficiency that is optimized relative to that obtainable with conventionally conditioned polishing pad surfaces. In an example embodiment of the present invention, the conditioned polishing pad surface has a surface roughness Ra≦3 microns. In another example embodiment of the invention, the conditioned polishing pad surface has a surface roughness Ra≦2 microns.

A benefit of the optimized polishing pad surface morphology is the ability to perform planarization or polishing using a lower contact pressure between the polishing pad and wafer than is normally required. This is because the reduced surface roughness results in more surface area of the polishing pad being in contact with the wafer, so that less downward force on the wafer is needed achieve the same amount of force per area. This benefit is particularly advantageous for polishing sensitive films, such as films having low and ultra-low dielectric constants. Such films are known to be prone to being damaged when subjected to the high stresses induced when performing CMP with high contact pressure.

Non-porous Pad Conditioning

Non-porous polishing pads, such as the model OXP 4000 by Rodel, Inc., Newark, Del., as discussed above, have a conventional conditioned surface roughness Ra≧3.5 microns. In the present invention, in one example embodiment a non-porous polishing pad is conditioned using conventional techniques to have a surface roughness Ra<3.5 microns. Advantageously, the non-porous polishing pad surface is conditioned to have a surface roughness Ra of 1 to 3 microns. Most advantageously, the conditioned non-porous polishing pad has a surface roughness Ra of 1 to 2 microns. Advantageously, the pad is a non-porous polymeric material. Most advantageously, the non-porous pad is a polyurethane-based polymer. Thus, in both example embodiments, conditioning is used to develop a pad surface having a surface roughness significantly less than that of the prior art.

Conventional conditioning techniques are used to achieve and maintain the low surface roughness morphology of the present invention. Such techniques include contacting the polishing pad surface with a diamond imbedded pad conditioner such as those available from the Kinik Company, Taipei, Taiwan. The low surface roughness pad morphology is obtained by utilizing conditioner designs characterized by relatively low cut-rates as compared to the prior art when employed at typical process settings.

In one example embodiment, porous polishing pad conditioning to achieve and maintain the morphology of the present invention is performed using a conventional in-situ conditioning tool mounted on a pivoting arm. The conditioning applies a cut-rate of about 25 nm/($lb_{cdf}$-$rpm_{platen}$-hour) or less in an in situ mode, where $lb_{cdf}$ represents the force applied to the conditioner in pounds, and $rpm_{platen}$ is the rotational speed of the polishing platen in revolutions per minute. Most advantageously, the conditioning applies a cut-rate of 10 to 25 nm/($lb_{cdf}$-$rpm_{platen}$-hour) in an in situ mode. In this embodiment, the conditioning arm motion is optimized to result in a substantially flat cut-rate profile in an approximately radial sweep across a 20–23 inch diameter platen.

These example embodiments are in contrast to the prior art high-aggressiveness conditioning, which applies a cut-rate of more than about 40 nm/($lb_{cdf}$-$rpm_{platen}$-hour) in an in-situ mode.

One example embodiment of a low aggressiveness conditioner design used to achieve the desired cut-rate and pad surface morphology employs cubic-octahedral diamonds characterized by a mean diameter of 195 um or greater, and a surface density of between 1 and 15/$cm^2$.

Porous Polishing Pads

Figure 5A:
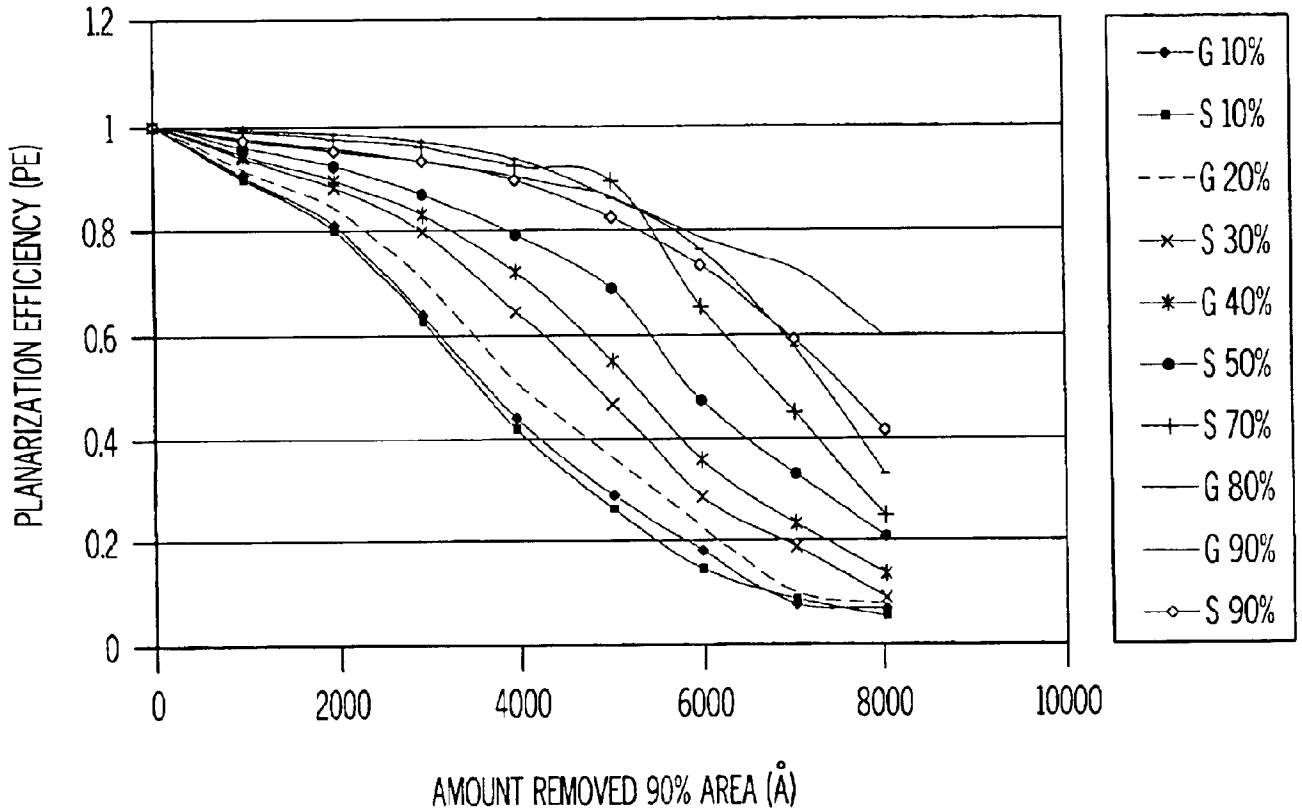
FIG. 5A (PRIOR ART)
FIG. 5A is a series of PE vs. AMR curves generated by planarizing wafers using a porous polishing pad with a conventional surface morphology.

With reference to FIG. 5A, there is shown a series PE vs. AMR curves generated by planarizing wafers using a Rodel IC1000 porous polishing pad. A conventional slurry (namely, Rodel ILD1300) was used in all cases. As in the case of the non-porous pads, the wafers used were a 200 mm TEOS $SiO_2$ wafers with different wafer pattern densities. The legend in the plot indicates the feature-scale density as a percentage of the surface area. The features used were step features formed in an oxide layer atop the silicon wafer. The letters "G" and "S" refer to "gradual" and "step."

Figure 5B:
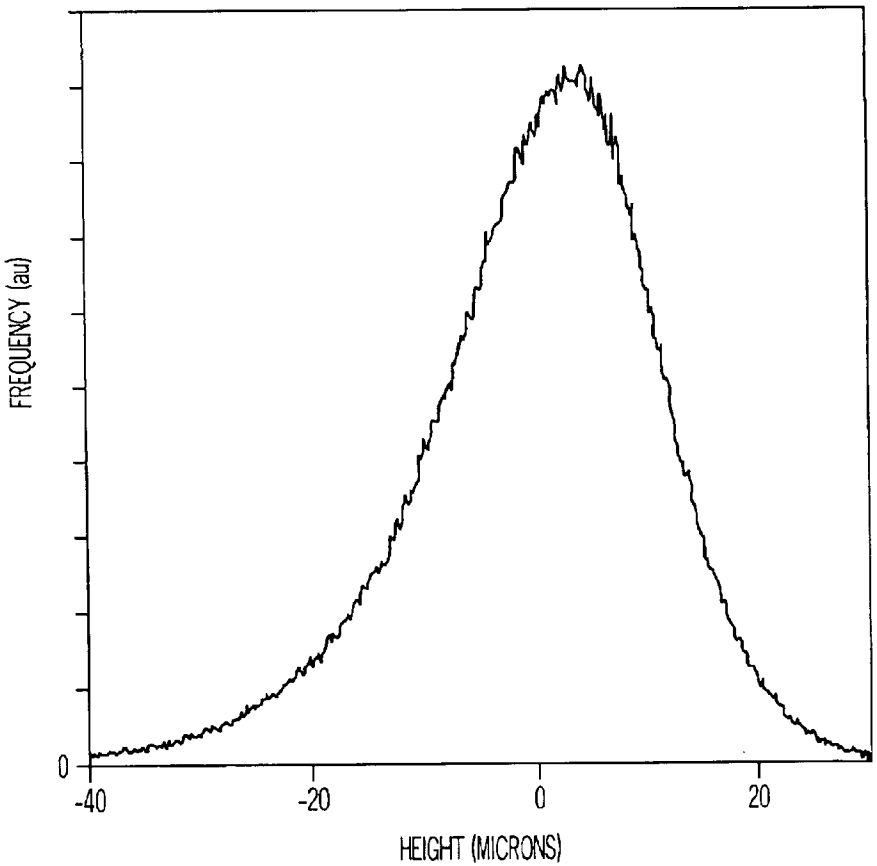
FIG. 5B (PRIOR ART)
FIG. 5B is a plot of height probability distribution (i.e., frequency versus height) for a conventional porous polishing pad such as used to create the curves of FIG. 5A.
Figure 5C:
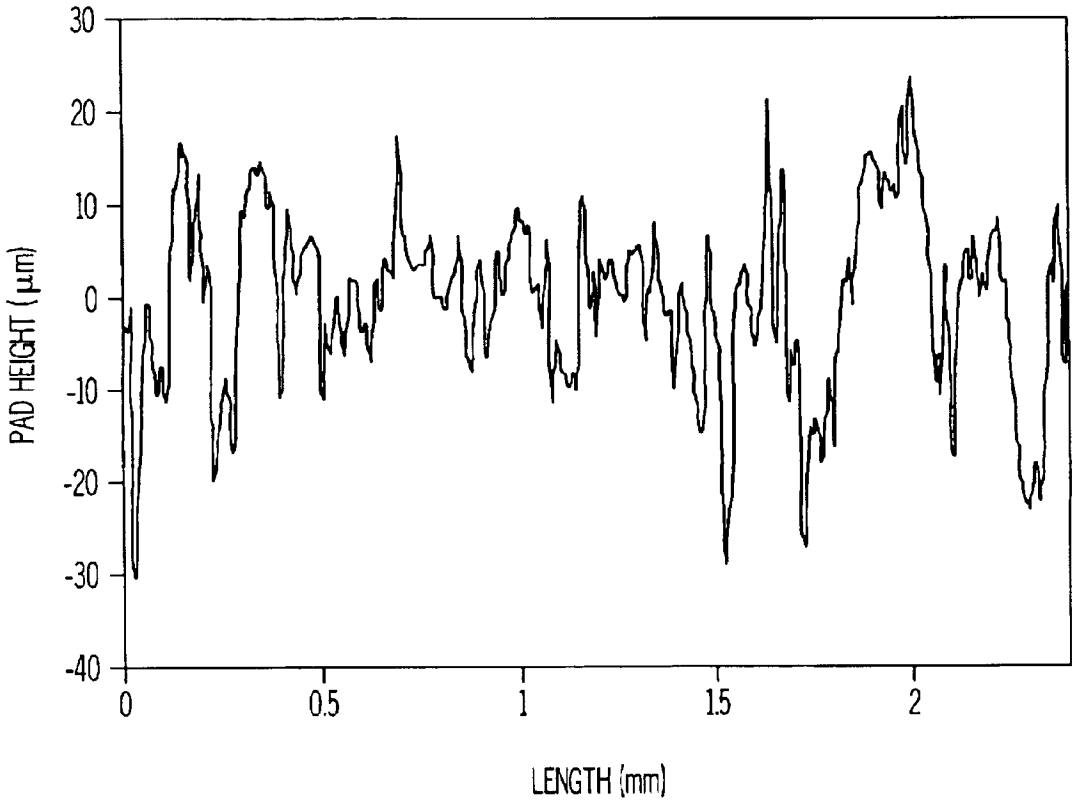
FIG. 5C (PRIOR ART)
FIG. 5C is a plot of the surface height h vs. distance X across the pad surface consistent with the height probability distribution of FIG. 5B, illustrating the surface morphology of a conventional porous polishing pad.

With reference to FIG. 5B, the pad surface employed had a substantially symmetric surface height probability distribution with a surface roughness of Ra=8 microns. FIG. 5C is a plot of surface height h (in microns) vs. distance x (microns) of a pad surface consistent with the height probability distribution (spectrum) of FIG. 5B.

The asymmetric nature of the surface roughness probability distribution illustrated in FIG. 5B arises in part from the inherent porosity of the pad material. Conventional porous polishing pads have a surface roughness of between 5 and 8 microns and a six-sigma height range of 50–75 microns. Accordingly, FIG. 5A is representative of the planarization efficiency associated with the prior art porous polishing pad surfaces.

Figure 6A:
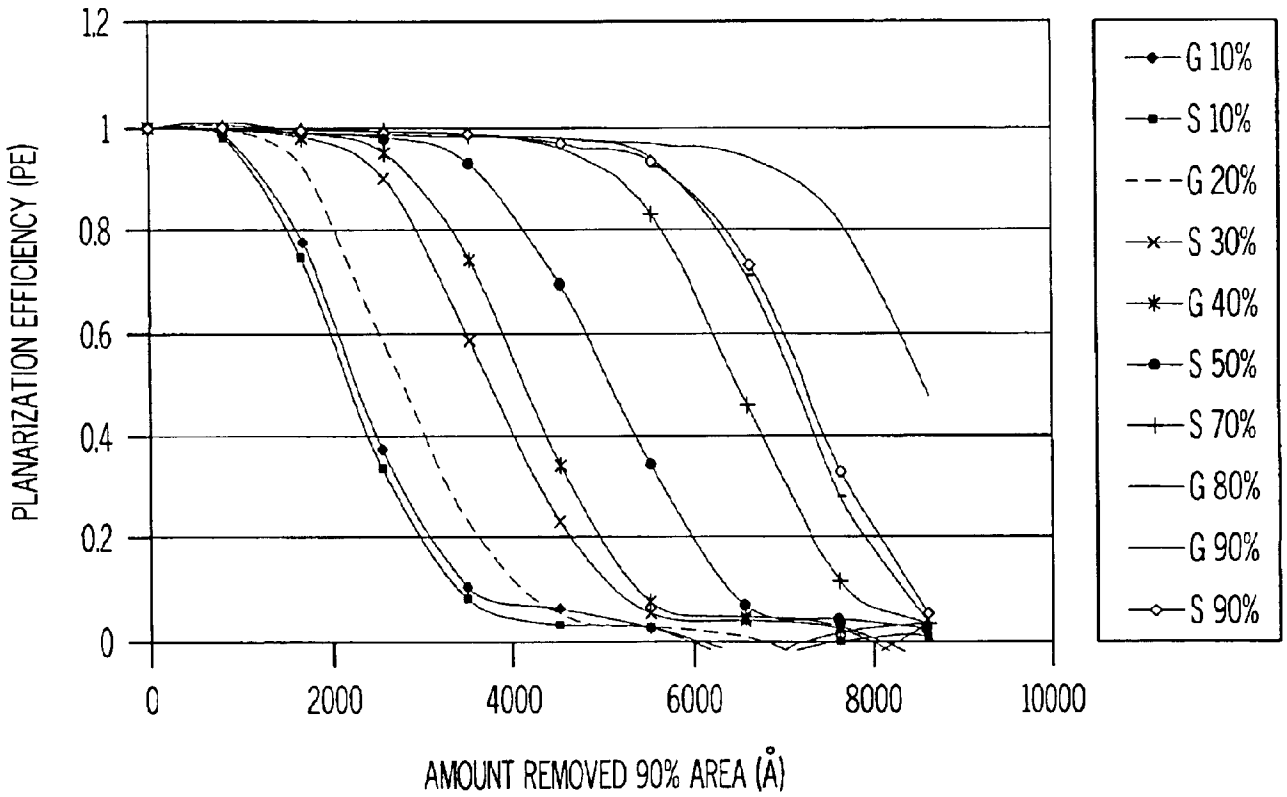
FIG. 6A is a series of PE vs. AMR curves generated by planarizing wafers using a porous polishing pad of the present invention.
Figure 6B:
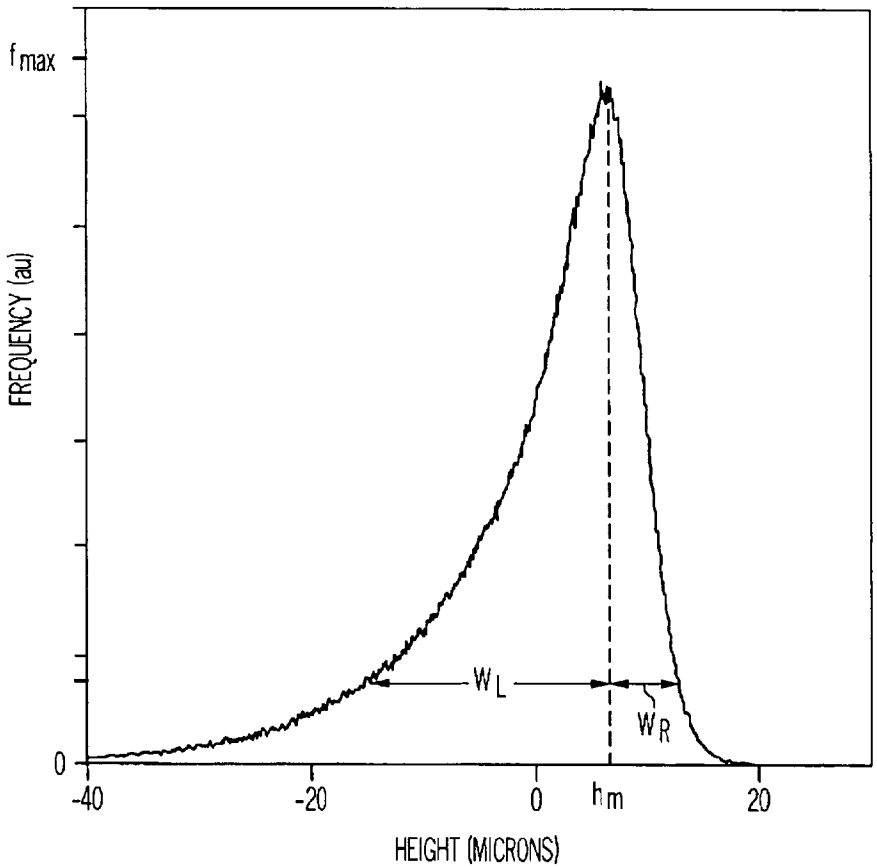
FIG. 6B is a plot of height probability distribution (i.e., frequency versus height) for a non-porous polishing pad of the present invention such as used to create the curves of FIG. 6A, showing an asymmetric spectrum.

With reference now to FIG. 6A, the same PE vs. AMR curves are shown, except that the polishing surface employed had an asymmetric height probability distribution with an associated surface roughness Ra=6.5 $\mu$m, as illustrated in FIG. 6B. Such a low surface roughness and asymmetric height probability distribution is atypical of conventional polishing pad surfaces.

The asymmetry of the surface height probability distribution of FIG. 6B can be quantified by measuring the half-widths of the distribution at 10% ($f_{10}$) of the maximum frequency ($f_{MAX}$) relative to the height $h_M$ where $f_{MAX}$ occurs. The value $W_L$ represents the half-width as measured to the left of $h_M$ and the value $W_R$ represents the half-width as measured to the right of $h_M$. The ratio of $W_R/W_L$ defines an asymmetry factor $A_{10}$. A perfect Gaussian distribution has an asymmetry factor of 1. The inventors have discovered that the optimum porous pad surface morphology has an associated asymmetry factor $A_{10} \leqq 0.50$.

Generally, features of different densities polish at different rates, with low-density features polishing faster (i.e., have a higher removal rates) and planarize sooner than high-density features. However, from FIG. 6A, it is clear that the polishing efficiency obtained is much higher than that of the prior art (FIG. 5A) even though the surface roughness of the polishing pad is much less. This is a counterintuitive result.

Figure 6C:
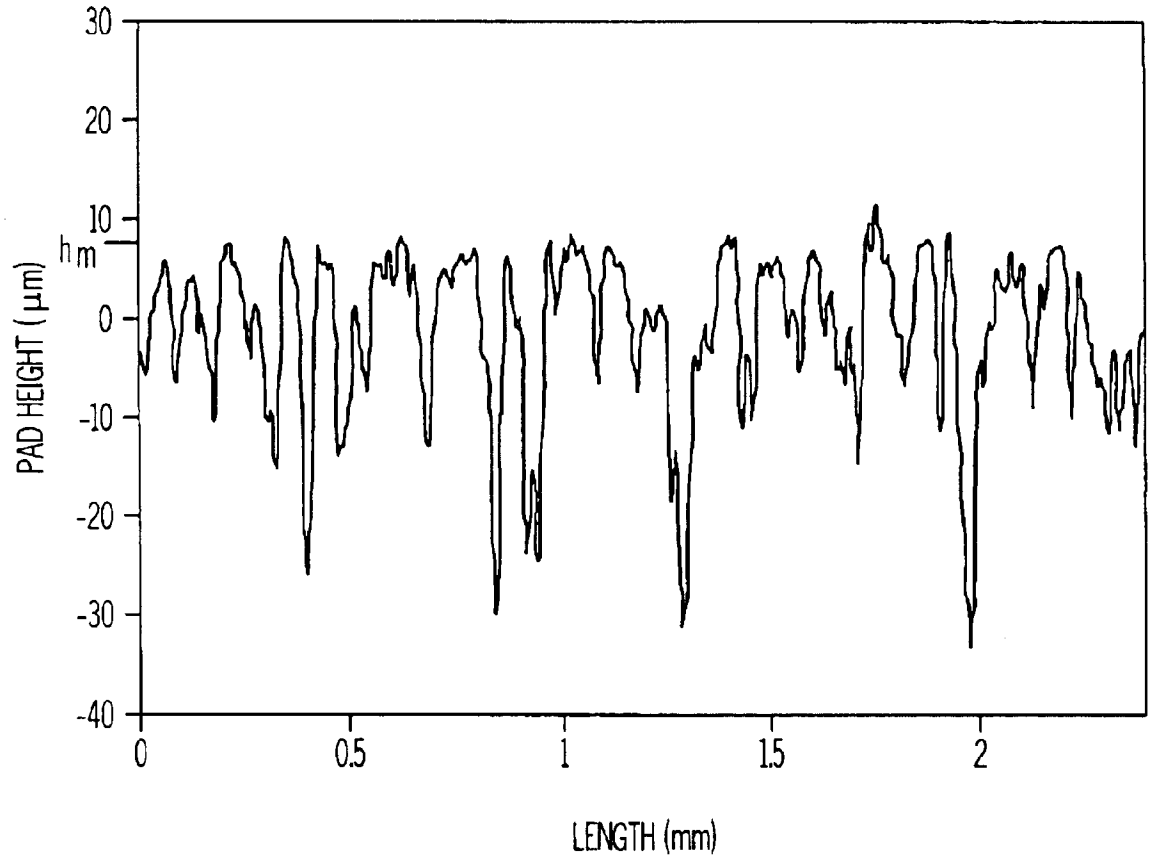
FIG. 6C is a plot of the surface height h vs. distance X across the pad surface consistent with the height probability distribution of FIG. 6B, illustrating the flattened surface morphology of porous polishing pad of the present invention.

FIG. 6C a plot of surface height h (in microns) vs. distance x (microns) of a pad surface consistent with the surface height probability distribution (spectrum) of FIG. 6B. Notable in FIG. 6C is that more of the pad surface is at a given height $h_A$ (hereinafter, the "pad surface height") as compared to the conventional (i.e., prior art) Gaussian surface of FIG. 5C. The pad surface height $h_A$ represents the statistical "mode" of the distribution, i.e., the height value that occurs most often. The pad surface of FIG. 6C is thus flatter than prior art polishing pads.

The flattened polishing pad can also be described as having a "flatness" characterized by a pad surface height ratio $R \geqq X$ %—meaning that X % or more of the surface is at or below the pad surface height $h_A$ that occurs with the maximum frequency. In respective example embodiments of the present invention, the conditioned polishing pad surface has a pad surface height ratio $R \geqq 60\%$. Advantageously, the conditioned polishing pad surface has a pad surface height ratio R of 60 to 95%. Most advantageously, the conditioned polishing pad surface has a pad surface height ratio R of 70 to 90%. Advantageously, the porous pad is a polymeric material. Most advantageously, the porous pad is a polyurethane-based polymer containing pores having an average size of less than 100 $\mu$m.

Comparing FIG. 5A to FIG. 6A shows that the flattened porous polishing pad surface of the present invention provides greater planarization efficiency as compared to a conventional porous polishing pad surface.

Porous Polishing Pad Conditioning

In one example embodiment, porous polishing pad conditioning to achieve the morphology of the present invention is performed using a conventional in-situ conditioning tool mounted on a pivoting arm. In an example embodiment, in a CMP system utilizing in-situ conditioning and a standard CMP process, the estimated pad-wafer contact area for a porous polishing pad such as the Rodel IC1000 is about 10% at typical process settings. The aggressive conditioning associated with prior art porous pad conditioning results in a pad-wafer contact area on the order of 2–5% at similar conditions. Thus, the applied pressure at the pad-wafer interface is 2–5 times lower with the conditioning methods of the present invention as compared to those of the prior art.

In an example embodiment, the conditioning applies a cut-rate of less than about 25 nm/($lb_{cdf}$-$rpm_{platen}$-hour) in an in-situ mode. In this embodiment, the conditioning arm motion is optimized to result in a substantially flat cut-rate profile in an approximately radial sweep across a 20–23 inch diameter platen.

In another example embodiment, pad conditioning results in a pad surface characterized by an asymmetry factor $\leqq 0.50$. Advantageously, the conditioning results in a pad surface characterized by an asymmetry factor of 0.10 to 0.50. Most advantageously, the conditioning results in a pad surface characterized by an asymmetry factor of 0.25 to 0.50.

These example embodiments are in contrast to the prior art high-aggressiveness conditioning, which applies a cut-rate of more than about 40 nm/($lb_{cdf}$-$rpm_{platen}$-hour) in an in situ mode.

One example embodiment of a low aggressiveness conditioning of a porous polishing pad according to the present invention employs cubic-octahedral diamonds characterized by a mean diameter of 195 microns or greater, and a surface density of between 1 and 15/cm$^2$.

In another example embodiment, conditioning is performed with a conditioning pad having abrasives (e.g., diamonds) that penetrate to a depth of up to 50 microns, and that also has a background layer that smears or "clips" the pad surface to form truncated asperities.

In yet another example embodiment, conditioning of a porous polishing pad is performed in a manner that truncates surface asperities, resulting in more of the pad surface occurring below the pad surface height $h_A$, as illustrated in FIG. 6C. The asperity structure of a porous polishing pad becomes less and less truncated as the conditioner aggressiveness is increased, as illustrated in FIG. 5C.

Truncated asperities are less likely to remove material from recessed features on the wafer surface and less likely to contribute to dishing and erosion during CMP. Further, pad surfaces characterized by truncated asperities tend to present more surface area to the wafer surface and thus require proportionally less surface pressure in polishing. This, in turn, reduces the likelihood of damage being inflicted to the surface during CMP.

Thus, in one example embodiment, conditioning a non-porous polishing pad is carried out by providing a conditioning pad with a surface having abrasives extending up to 50 microns therefrom, and then contacting the conditioning pad surface to the non-porous polishing pad surface. The conditioning pad surface is then moved relative to the non-porous polishing pad surface while providing a force that presses the surfaces together. The process is carried out to form and maintain a surface roughness in the non-porous polishing pad surface characterized by an asymmetric surface height probability distribution having an asymmetry factor $A_{10} \leqq 0.50$.

In another example embodiment, the same process is carried out such that the surface height probability surface distribution has a pad surface height ratio $R \geqq 60\%$. In yet another example embodiment, the process is carried out such that $R \geqq 70\%$.

CMP System

Figure 7:
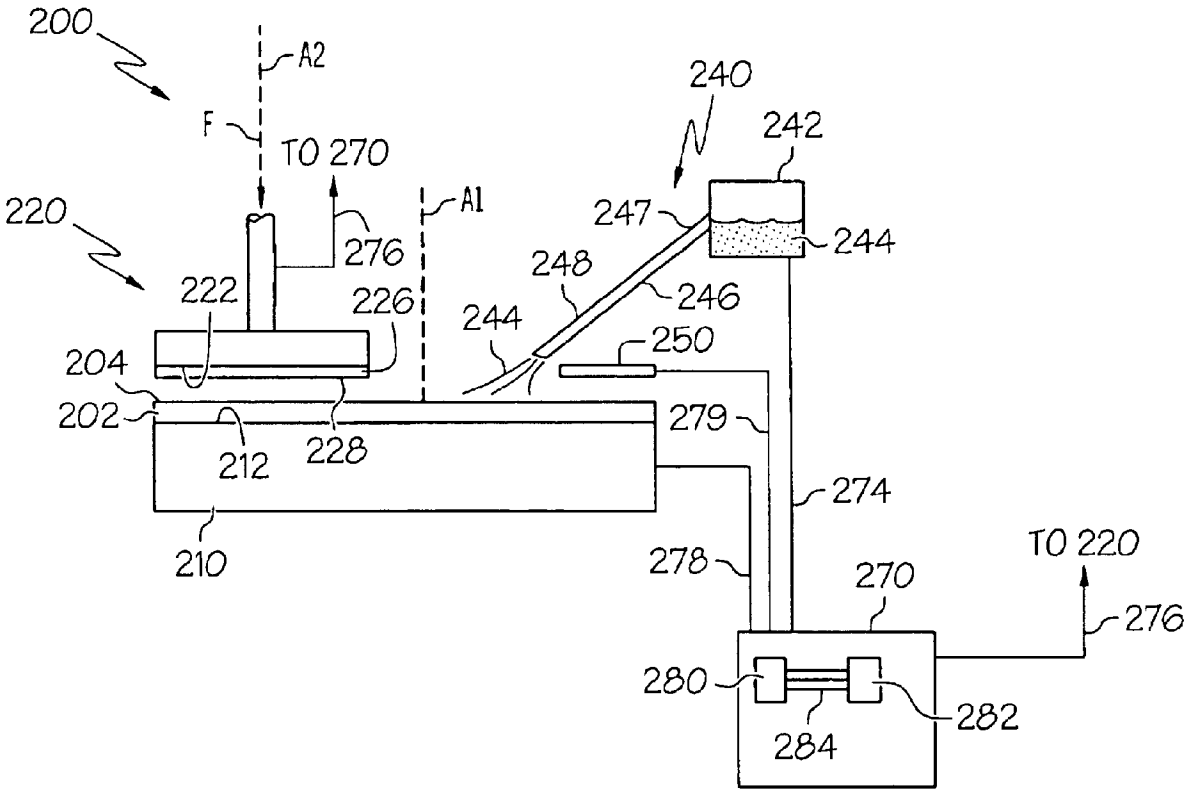
FIG. 7 is a side view of a CMP apparatus having the polishing pad of the present invention.

FIG. 7 shows a CMP system 200 that employs an embodiment of a polishing pad 202 of the present invention as described in detail above. Polishing pad 202 has an upper surface 204. System 200 includes a polishing platen 210 rotatable about an axis A1. Platen 210 has an upper surface 212 upon which pad 202 is mounted. A wafer carrier 220 rotatable about an axis A2 is supported above polishing pad surface 204. Wafer carrier 220 has a lower surface 222 parallel to pad upper surface 204. Wafer 226 is mounted to lower surface 222. Wafer 226 has a surface 228 that faces polishing pad surface 204. Wafer carrier 220 is adapted to provide a downward force F so that wafer surface 228 is pressed against polishing pad surface 204.

System 200 also includes a slurry supply system 240 with a reservoir 242 (e.g., temperature controlled) that holds a slurry 244. Slurry supply system 240 includes a conduit 246 connected at a first end 247 to the reservoir and a second end 248 in fluid communication with the pad upper surface 204 for dispensing slurry 244 onto the pad.

System 200 further includes a pad conditioning member 250 in operable communication with pad upper surface 204. Pad conditioning member 250 is adapted to condition upper pad surface 204 in accordance with the present invention as described above. In one example embodiment, pad conditioning member 250 includes a conventional sweeping conditioning arm with a conditioning tool (e.g., a conditioning pad) at one end. In another example embodiment, pad conditioning member 250 is a conventional conditioning ring.

System 200 also includes a controller 270 coupled to slurry supply system 240 via a connection 274, to wafer carrier 220 via a connection 276, to polishing platen 210 via a connection 278, and to pad conditioning member 250 via a connection 279. Controller 270 controls these system elements during the polishing operation. In an example embodiment, controller 270 includes a processor (e.g., a CPU) 280, a memory 282 connected to the processor, and support circuitry 284 for supporting the operation of the processor, memory and other elements in the controller.

With continuing reference to FIG. 7, in operation controller 270 activates slurry supply system 240 to dispense slurry 244 onto the rotating polishing pad upper surface 204. The slurry spreads out over the polishing pad upper surface, including the portion of the surface beneath wafer 226. Controller 270 also activates wafer carrier 220 to rotate at a select speed (e.g., 0 to 150 revolutions-per-minute or "rpm.") so that wafer surface 228 moves relative to polishing pad surface 204.

Wafer carrier 220 also provides a select downward force F (e.g., 0–15 psi) so that wafer surface 228 is pressed against polishing pad surface 204. Controller 270 further controls the rotation speed of the polishing platen, which speed is typically between 0–150 rpm. In conjunction with the polishing of wafer 226, controller 270 controls pad conditioning member 250 to condition polishing pad surface 204. The pad surface conditioning is performed in the manner described in detail above, with the particular conditioning method depending on whether polishing pad surfaced 204 is non-porous or porous.

Because polishing pad surface 204 has an optimized surface morphology, the planarization efficiency is greater than what has been achievable by conventional means. Increased planarization efficiency results in less material being removed from the wafer, more efficient step height removal, and in the case of the present invention, less chance of damaging the wafer surface.

What is claimed is:

1. A polishing pad suitable for chemical mechanical planarization, comprising:

a porous pad conditioned surface having a substantially flat surface characterized by a surface height probability distribution with a pad surface height ratio $R \geqq 60\%$.

2. The polishing pad of claim 1, wherein R is $\geqq 70\%$.

3. A polishing pad suitable for chemical mechanical planarization, comprising:

a porous pad conditioned surface characterized by an asymmetric surface height probability distribution having an asymmetry factor $A_{10} \leqq 0.50$.

4. The polishing pad of claim 3 wherein the surface height probability distribution has a pad surface height ratio $R \geqq 60\%$.

5. The polishing pad of 4 wherein R is $\geqq 70\%$.

* * * * *